US005275277A

United States Patent [19]

Gallegos

[11] Patent Number: 5,275,277

[45] Date of Patent: Jan. 4, 1994

[54] NOVELTY DRINKING GLASS

[76] Inventor: Benjamin Gallegos, 129 Wardwell St., Stamford, Conn. 06902

[21] Appl. No.: 967,421

[22] Filed: Oct. 28, 1992

[51] Int. Cl.[5] ..... B65D 77/04; G09F 3/00

[52] U.S. Cl. ..... 206/217; 206/457; 220/663; 220/703; 40/324

[58] Field of Search ..... 206/217, 457; 215/13.1, 215/365; 220/662, 663, 665, 506, 703, 427; 137/558, 559; 40/310, 324

[56] References Cited

U.S. PATENT DOCUMENTS

| | | | |
|---|---|---|---|
| 3,874,977 | 4/1975 | Pyles | 40/324 |
| 4,047,633 | 9/1977 | Trombly | 220/665 X |
| 4,570,454 | 2/1986 | Campbell | 215/13.1 X |
| 4,928,412 | 5/1990 | Nishiyama | 40/324 |
| 5,040,317 | 8/1991 | Kadjevich | 220/662 X |

*Primary Examiner*—Steven N. Meyers
*Assistant Examiner*—Jacob K. Ackun, Jr.
*Attorney, Agent, or Firm*—Leon Gilden

[57] ABSTRACT

A drinking glass includes a side wall having a transparent circuitous path directed thereafong extending from entrance of the drinking glass to a second position in adjacency to a floor portion of the drinking glass to indicate fluid level within the drinking glass structure. Various nomenclature and educational indicia spaces are provided along the circuitous path. A modification includes the drinking glass having a spacing to permit various webs positionable within the drinking glass side wall structure to vary the information and educational indicia available to an individual.

1 Claim, 4 Drawing Sheets

NOVELTY DRINKING GLASS

BACKGROUND OF THE INVENTION

1. Field of the Invention

The field of invention relates to drinking glass structure, and more particularly pertains to a new and improved novelty drinking glass wherein the same is arranged for the education and entertainment of individuals during drinking of fluid from a drinking glass.

2. Description of the Prior Art

Drinking glasses of various types have been utilized throughout the prior art for the entertainment, amusement, and manner of positioning a drinking glass relative to a support surface such as indicated in U.S. Pat. No. 4,040,535 to Shephard, wherein a condensation reservoir is mounted within a support of a drinking glass.

U.S. Pat. No. 3,599,362 to Klober sets forth a drinking glass having a conically widened portion relative to an associated drinking glass clamping itself thereto in an engaging fit.

U.S. Pat. No. 4,239,223 to Wilson sets forth a drinking glass having a transparent bottom portion having a novelty game portion positioned therewithin.

The instant invention attempts to overcome deficiencies of the prior art by providing for a drinking glass wherein fluid level visibility is available to an individual during a drinking procedure, wherein various indicia and messages are positioned about the circuitous path for the entertainment and amusement of an individual to assist in an incentive, particularly to children and the like, for the drinking of fluids from a drinking glass and in this respect, the present invention substantially fulfills this need.

SUMMARY OF THE INVENTION

In view of the foregoing disadvantages inherent in the known types of drinking glass structure now present in the prior art, the present invention provides a novelty drinking glass wherein the same employs a plurality of messages directed in adjacency along a transparent circuitous path of a drinking glass to encourage drinking of fluid from a drinking glass. As such, the general purpose of the present invention, which will be described subsequently in greater detail, is to provide a new and improved novelty drinking glass which has all the advantages of the prior art drinking glass structure and none of the disadvantages.

To attain this, the present invention provides a drinking glass including a side wall having a transparent circuitous path directed therealong extending from entrance of the drinking glass to a second position in adjacency to a floor portion of the drinking glass to indicate fluid level within the drinking glass structure. Various nomenclature and educational indicia spaces are provided along the circuitous path. A modification includes the drinking glass having a spacing to permit various webs positionable within the drinking glass side wall structure to vary the information and educational indicia available to an individual.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved novelty drinking glass which has all the advantages of the prior art drinking glass structure and none of the disadvantages.

It is another object of the present invention to provide a new and improved novelty drinking glass which may be easily and efficiently manufactured and marketed.

It is a further object of the present invention to provide a new and improved novelty drinking glass which is of a durable and reliable construction.

An even further object of the present invention is to provide a new and improved novelty drinking glass which is susceptible of a low cost of manufacture with regard to both materials and labor, and which accordingly is then susceptible of low prices of sale to the consuming public, thereby making such novelty drinking glasses economically available to the buying public.

Still yet another object of the present invention is to provide a new and improved novelty drinking glass which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
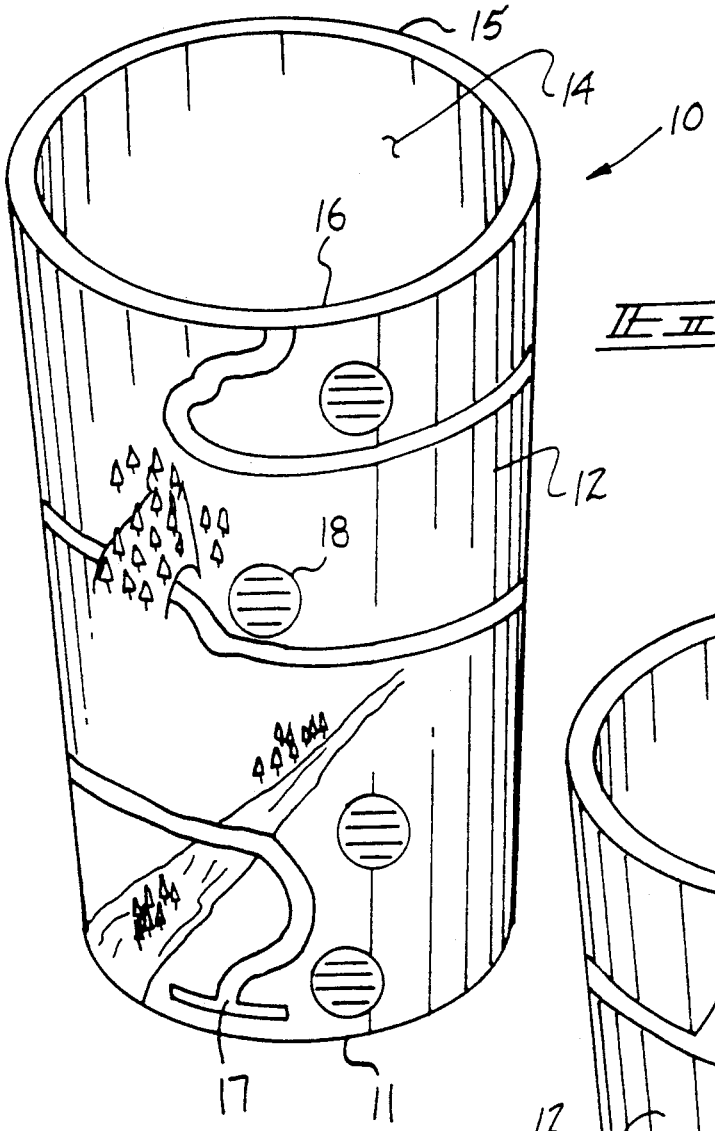
FIG. 1 is an isometric illustration of the instant invention.

With reference now to the drawings, and in particular to FIGS. 1 to 10 thereof, a new and improved novelty drinking glass embodying the principles and concepts of the present invention and generally designated by the reference numerals 10 and 10*a* will be described.

Figure 2:
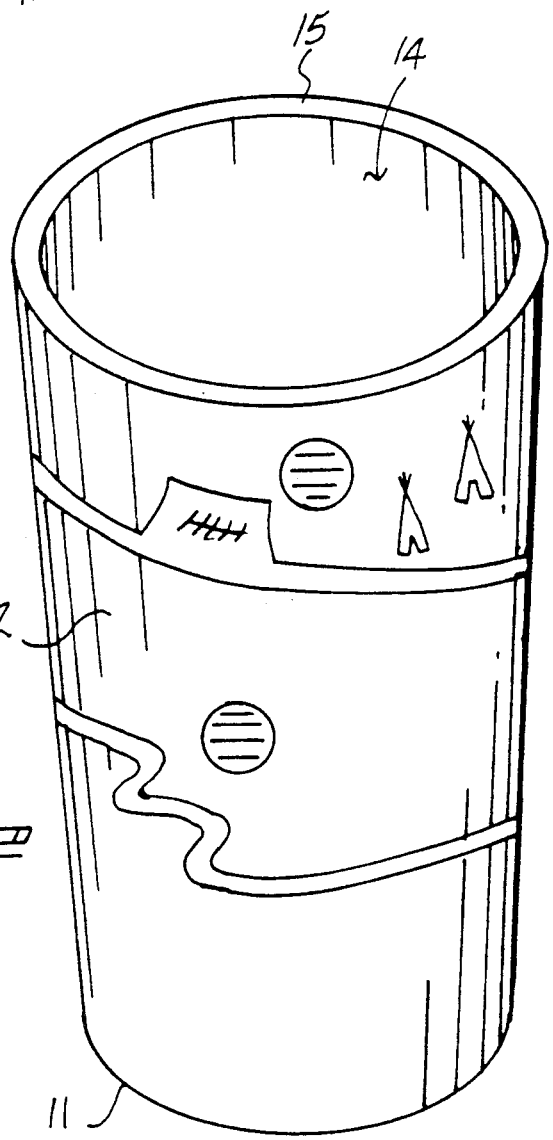
FIG. 2 is an isometric rear view of the invention as set forth in FIG. 1.

More specifically, the novelty drinking glass 10 of the instant invention essentially comprises a drinking glass structure as indicated in FIGS. 1 and 2 for example, having a floor 11 with a continuous opaque side wall 12 terminating in an entrance opening 14, with the side wall terminating in an entrance opening edge 15. A transparent curvilinear path 3 is provided extending visibly through the side wall 12 extending from the entrance opening edge 15 to an orientation in adjacency to the floor 11. A plurality of informational inscriptional spaces 8 are positioned in adjacency along the path 3 to an interior surface of the wall 12. In this manner, a child drinking from the glass 10 is tempted to associate various goals by various of the spaces 8 providing additional information indicating achievement of drinking fluid to drop the visible fluid level as visibly available through the transparent curvilinear path 3. The path accordingly has a first end 16 in adjacency to the entrance opening edge 15 and a second end 17, as indicated in FIG. 1 for example.

Figures 3, 4:
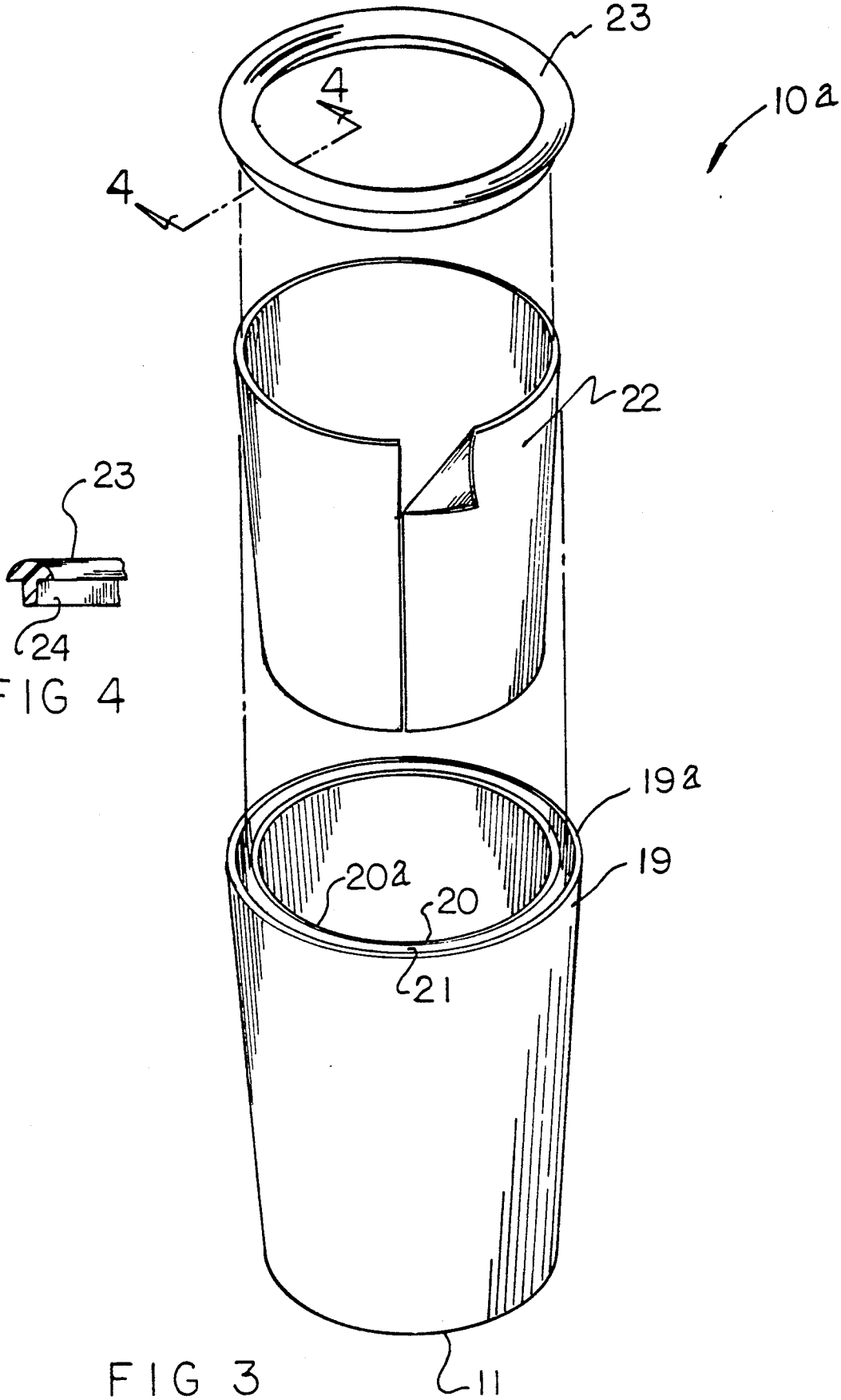
FIG. 3 is an isometric exploded modified aspect of the invention.
FIG. 4 is an orthographic view, taken along the lines 4—4 of FIG. 3 in the direction indicated by the arrows.
Figure 6:
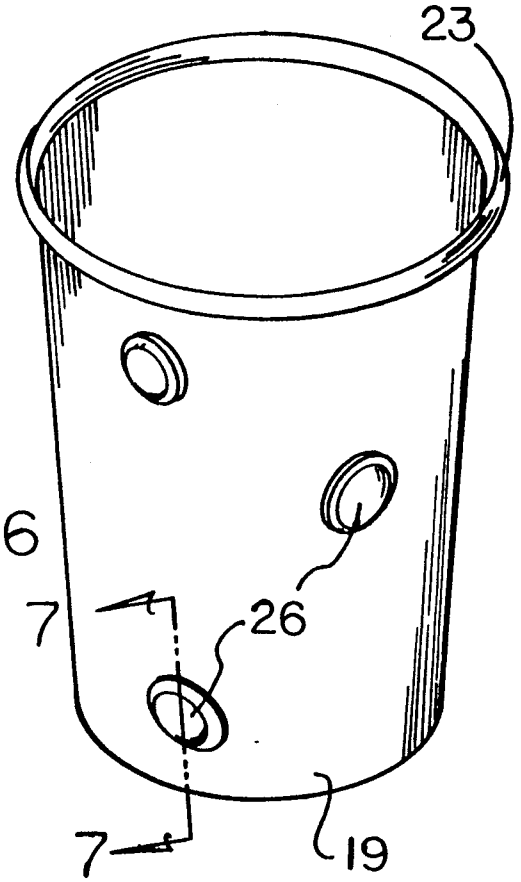
FIG. 6 is an isometric illustration of the drinking glass structure employing a magnification lens positioned in adjacency relative to a respective indicia space.
Figure 5:
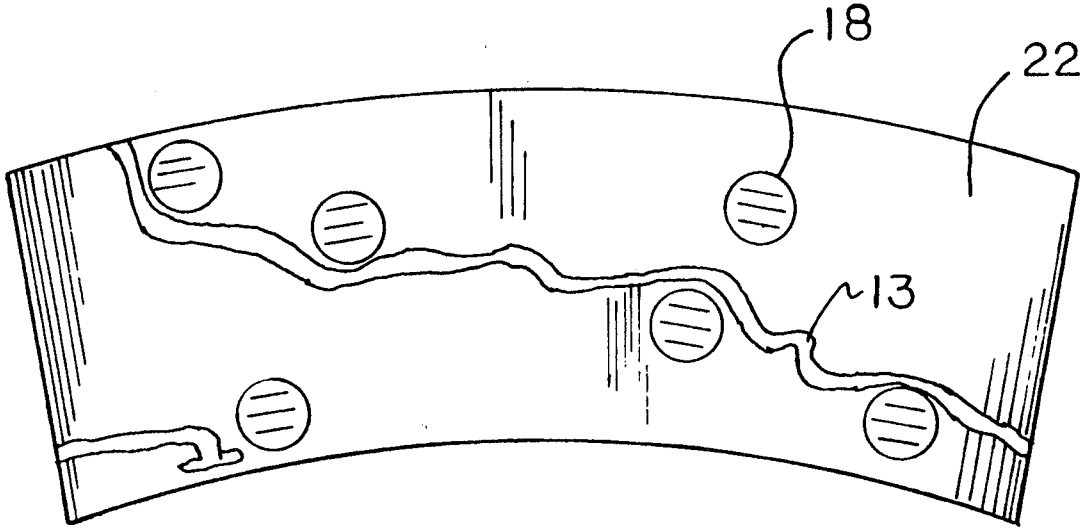
FIG. 5 is an orthographic view of a conventional web insert utilized by the invention.
Figure 7:
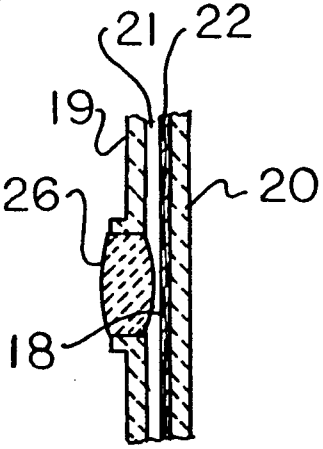
FIG. 7 is an orthographic view, taken along the lines 7—7 of FIG. 6 in the direction indicated by the arrows.
Figure 8:
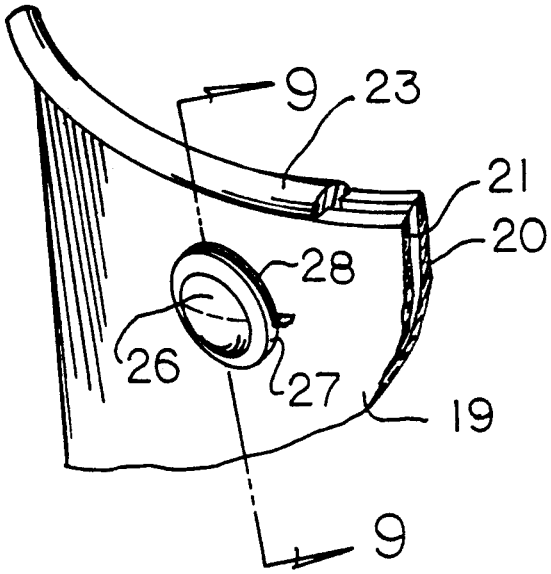
FIG. 8 is an enlarged isometric illustration of a modified magnification lens structure utilized by the invention.
Figure 9:
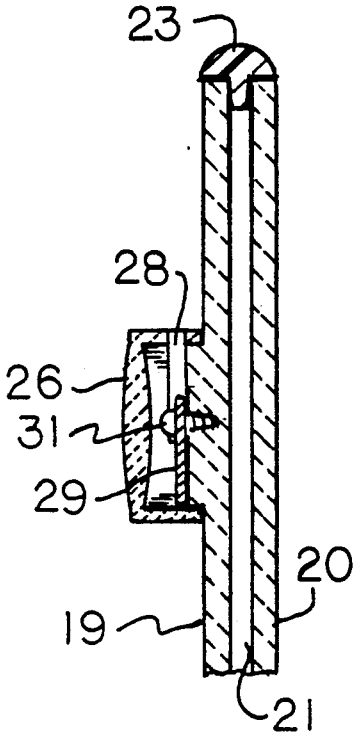
FIG. 9 is an orthographic view, taken along the lines 9—9 of FIG. 8 in the direction indicated by the arrows.
Figure 10:
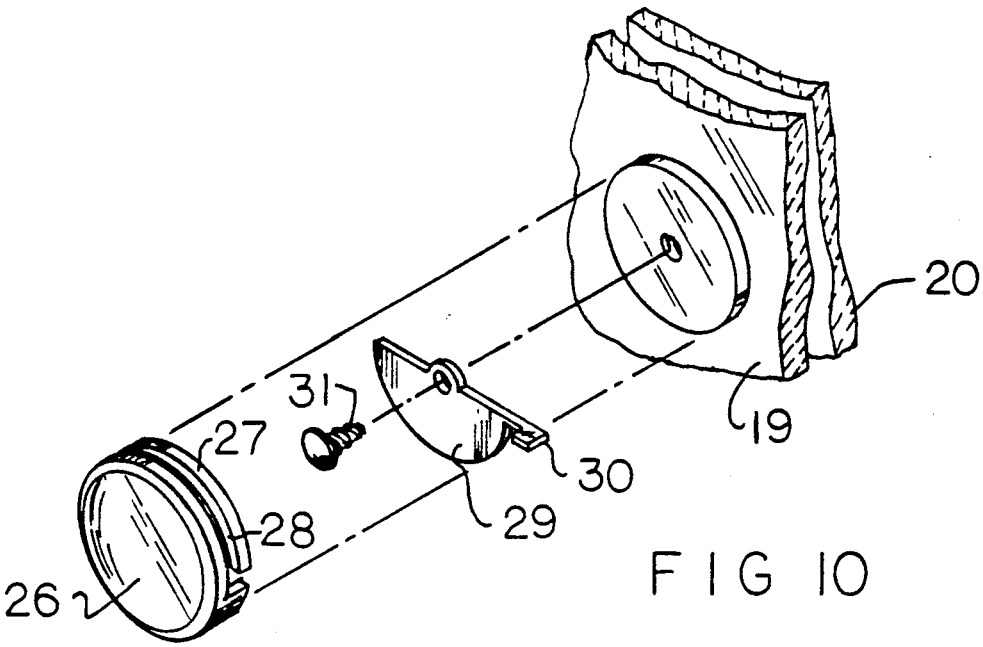
FIG. 10 is an exploded illustration of the magnification lens housing relative to the drinking glass side wall structure.

The FIG. 3 indicates the use of a drinking glass structure 10*a* having an outer transparent wall 19 coextensive with an inner transparent wall 20 in concentric relationship and coextensive relative to one another. The outer wall 19 terminates in an outer wall upper edge 19*a*, with the inner wall 20 terminating in an inner wall upper edge 20*a*, with a cylindrical tubular gap 21 oriented between the inner and outer walls arranged to receive an insert web 22. The insert web 22 is opaque to include the transparent path 13 therethrough, whereupon positioning the web 22 within the gap 21, the circuitous and curvilinear transparent path 13 is once again visible throughout the side wall structure of the glass structure 10*a* further including spaced informational spaces 18 adjacent the path 13. A sealing ring 23 having a resilient flange 24 is directed within the cylindrical gap between the outer and inner wall upper edges 19*a* and 20*a*. Along the path 13 within the web is the positioning of the informational spaces 18, in a manner as discussed relative to FIGS. 1 and 2. The FIGS. 6–10 indicates the outer wall 19 having a plurality of magnifications lenses 26 arranged for coaxial alignment with a respective one of the spaces 18, in a manner as indicated in FIG. 7, to provide for ease of reading of the spaces 18 when the fluid level drops to each respective space visible along the path 13. The FIGS. 8–10 indicates that each magnification lens 26 is mounted within a lens housing 27, that includes a housing slot 28. Positioned rotatably between the lens 26 and the outer wall 19 is a semi-cylindrical opaque plate 29 received within the housing, with each plate 29 having a plate handle 30 projecting through the slot 28 to permit ease of rotation of pivoting of the plate to uncover various portions of the message mounted on the web 22. The opaque plate 29 is mounted rotatably about an axle 31 that is orthogonally mounted into the outer wall 19 between the lens 26 and the outer wall 19, in a manner as indicated in the FIGS. 9 and 10 for example.

In this manner, upon the fluid level within the glass 10*a* reaching levels along respective of the informational spaces 18, the respective plates are rotated via their handle to uncover various portions of the message to further provide for entertainment and amusement of a child and to induce such child to pursue consumption of fluid from within the glass structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A novelty drinking glass, comprising, a floor, and a continuous opaque side wall extending upwardly from the floor, with a transparent curvilinear path in the side wall, with the side wall having a side wall upper edge, and the path extending from the side wall upper edge to the floor, a plurality of spaced apart information spaces "for receiving information thereon"; positioned on the side wall along the continuous path in adjacency to the continuous path, and said side wall comprising a transparent inner wall and a transparent outer wall concentric therewith, said inner and outer walls extending upwardly from said floor and defining a cylindrical gap therebetween, said cylindrical gap sealed by a sealing ring received within the gap at an upper edge of said inner and outer walls, and an opaque insert web positioned within the gap so as to be substantially coextensive with said inner and outer walls, said insert web defining said curvilinear path therethrough and further comprising said plurality of spaced apart information spaces positioned on a surface thereof along said curvilinear path between said insert web and said outer wall, said transparent inner and outer walls and said opaque insert web having said curvilinear path therethrough and said information spaces thereon defining said continuous opaque side wall with said transparent curvilinear path therein and said informational spaces thereon, and wherein each information space includes a magnification lens mounted to the side wall in a facing relationship to each said information space, and each magnification lens is mounted within a cylindrical housing, and each cylindrical housing includes a housing slot, and a semi-cylindrical opaque plate is mounted within each housing between said magnification lens and the side wall, and each opaque plate includes a handle extending exteriorly of the housing through the slot to permit pivoting of the plate relative to the cylindrical housing, and each plate includes an axle mounting each plate relative to the side wall.

* * * * *